US008872009B2

(12) United States Patent
Siwko

(10) Patent No.: US 8,872,009 B2
(45) Date of Patent: Oct. 28, 2014

(54) SOUND POST INSERTING / REMOVING TOOL

(76) Inventor: Karol Siwko, Ocala, FL (US)

( * ) Notice: Subject to any disclaimer, the term of this patent is extended or adjusted under 35 U.S.C. 154(b) by 742 days.

(21) Appl. No.: 13/106,756

(22) Filed: May 12, 2011

(65) Prior Publication Data

US 2011/0259170 A1 Oct. 27, 2011

Related U.S. Application Data

(60) Provisional application No. 61/441,082, filed on Feb. 9, 2011.

(51) Int. Cl.
*G10D 9/00* (2006.01)
*G10D 3/02* (2006.01)

(52) U.S. Cl.
CPC ..... *G10D 3/02* (2013.01)
USPC ..... 84/453; 84/277

(58) Field of Classification Search
USPC ..... 84/453
See application file for complete search history.

(56) References Cited

U.S. PATENT DOCUMENTS

| | | | | | |
|---|---|---|---|---|---|
| 470,778 | A | | 6/1891 | Lewis | |
| 1,466,681 | A | | 8/1923 | Todd | |
| 1,556,340 | A | * | 10/1925 | Myers | 84/277 |
| 1,559,657 | A | * | 11/1925 | Todd | 84/277 |
| 2,609,198 | A | * | 9/1952 | Armstrong | 473/133 |
| 5,804,748 | A | * | 9/1998 | Clayton, Sr. | 84/458 |
| 6,482,239 | B1 | | 11/2002 | Jones | |
| 2009/0277319 | A1 | | 11/2009 | Beter | |

* cited by examiner

*Primary Examiner* — Christopher Uhlir

(57) ABSTRACT

Violin Sound Post inserting tool with a handle having a spring type clamp attached at right angle. One half of the clamp has a groove or cradle into which sound post is placed. The second half is a spring plate which secures the Sound Post in the clamp. After the sound post has been introduced and firmly set inside the violin sound box the spring plate of the clamp can be deflected by pressure against the sound post, thus opening the clamp. Also the spring plate has extended lip beyond the cradle, thus with the clamp open the sprig part is made to slide along the sound post without interference from the cradle of the base plate.

14 Claims, 8 Drawing Sheets a11
A
B
D
C
A
B
D
C a11
a12
A
Vv
B
A
B

Vh

SOUND POST INSERTING / REMOVING TOOL

CROSS REFERENCE TO RELATED APPLICATIONS

This application claims the benefits of U.S. Provisional Patent Application No. 61/441,082, which is incorporated by reference herein.

FIELD OF THE INVENTION

This invention relates to tools for inserting Sound Post into violins and other string instruments that include a Sound Post in their construction.

RELATED PRIOR ART

A variety of tools have been used to insert and set a sound post inside stringed musical instrument. Beginning with a piece of coat hanger wire sharpened at one end to pierce and hold the sound post ready for inserting, patent U.S. Pat. No. 6,482,239 B. A variation of such tool is now commonly used. Main difficulty arises while attempting to insert the sound post through narrow F-hole in instrument sound box without dropping the sound post. In early 1900's a generation of tools that can hold a sound post more securely in a partially open cradle has been started, U.S. Pat. No. 1,559,667A. This exhibits substantial, although still limited performance advancement. In most instances design handle is made from hollow tube and spring mechanisms are used to achieve some control, making this complex and extremely expansive. A number of this type tools have been reinvented with some additional options and varying amount of success. Two sound post retaining mechanisms are used, either sharp pin running through the handle, in which case handle is straight limiting insertion options, in order to overcome this, the handle is made parallel to the cradle, and this calls for flexible retaining pin, making the tool even more complex. Second retaining mechanism uses flexible line threaded through hollow handle, and additional mechanism for tension control is included, patent U.S. Pat. No. 5,804,768A and many more. Here the handle can be gradually bent to make the handle end parallel to the cradle, sharp bends of the handle result in difficulty threading the string through the handle, and even with best designs it can be time consuming. This type tool is costly and it is useless when removing and resetting of the sound post. All known methods require either costly tools or high degree of skill and dexterity.

This invention eliminates or reduces problems with existing tools.

Simple Common Knowledge

U.S. Pat. No. 470,778, although it will not work with sound post, demonstrates that a component, (a screw) can be attached to a tool (screw driver) and automatically released after proper placement.

Using springs to pick up and hold objects Such as commonly known pair of tweezers in closed position and having ends flared out can easily be used to pick up and retrieve an object by pushing on an object like fallen sound post, however this would make horrible sound post setter. This characteristic will be applied in the invention.

SUMMARY

This invention provides simple approach of holding a sound post in the tool and releasing it upon insertion into the sound box of a violin or similar string instrument. The principle of operation is similar to that of spring loaded self locking clamp, which is attached to a handle and the clamp is offset so it can reach a desired spot inside the violin sound box. One side of the clamp has indentation at its end to provide a cradle for the Sound Post. Second side is a Spring Plate applying pressure on the sound post, thus retaining it in the cradle. The Spring Plate is made longer to extend beyond the cradle of the first part and can also be deflected to open the clamp.

The Sound Post can then be moved and released by maneuvering the handle portion at the outside of the instrument sound box. The sound post movement can be achieved by either moving or tuning of the handle. The unique part of this invention is that the sound post is held by the tool accurately, upon insertion is easily released, and the tool is easy to use. Also the tool can be easily engaged with sound post already in the instrument, thus allowing safe removing and resetting. Further the construction of the tool is extremely simple and is easy to produce at much lower cost than currently available tools.

Following letters are assigned to identify these components in all drawings

'A' refers to Handle
'B' refers to Base Plate
'C' Refers to Spring Plate
'D' Refers to Sound Post
Violin Sound Box Main components of a violin and other similar string instrument include the Sound box, Finger board, Strings and Bridge. Tone or pitch of the sound is controlled by pressing the string against the finger board thus changing the effective length of the string. String is made to vibrate by plucking or bowing and transfers the sound through the Bridge to the top acoustic plate of the Sound Box, which amplifies and projects the sound. The inside of the top plate of the sound box is reinforced by a Bass Bar permanently glued under the bass side of the bridge. The Sound Post is inserted inside the Sound Box, between the top and bottom acoustic plates, under the treble leg of the bridge. This strengthens the violin and transfers sound vibrations to the bottom plate. The position of the Sound Post affects sound quality. Introducing the sound post through a relatively narrow hole in the top plate requires special tools. Existing tools either require skill and manual dexterity or are expensive. Generally this work has been left mostly to specialists.

DETAILED DESCRIPTION

Figure 1:
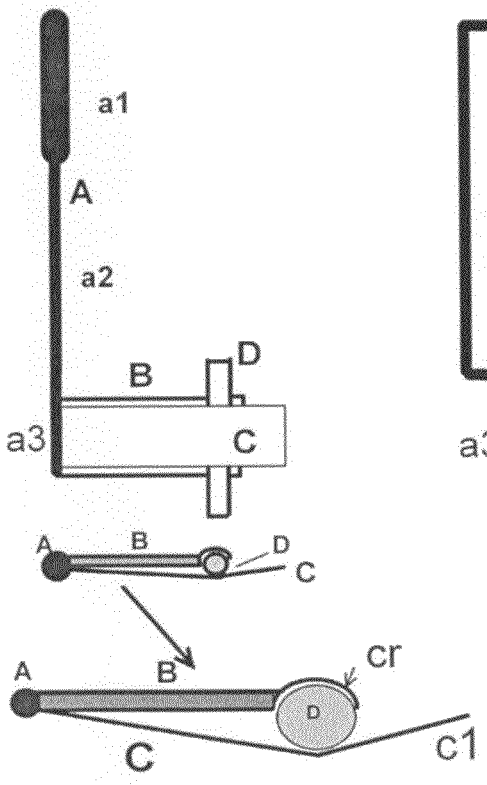
FIG. 1 Basic concept
FIG. 2 Concept options
FIG. 3 Operating Principle
FIG. 4 Sound Post placement inside violin sound box
FIG. 5 Various configurations of Base Plate
FIG. 6 Base plate as part of handle
FIG. 7 Base plate solid
FIG. 8 Base plate formed from thin material
FIG. 9 Base plate from thin plate
FIG. 10 Base plate from thin plate with modified for rigidity
FIG. 11 Base plate from thin plate stiffened by indentations
FIG. 12 Handle with integrated base plate
FIG. 13 Tool incorporating Handle with integrated base plate
FIG. 14 Tool incorporating clamp made from single strip
FIG. 15 Clamp made from single strip with flat handle end
FIG. 16 Clamp made from single strip with forked handle end
FIG. 17 Clamp made from single strip with looped handle end
FIG. 18 Handle with end providing offset
FIG. 19 Handle with end providing offset
FIG. 20 Tool using Handle with end with offset
FIG. 21 Clamp mounting method
FIG. 22 Clamp mounting method
FIG. 23 Tool picture with clamp providing offset
FIG. 24 Tool picture with handle providing offset
FIG. 25 Tool with integrated handle and base.

Basic construction: FIG. 1 shows offset spring clamp attached to a handle, also includes enlarged detail of top view of the clamp. The clamp consists of preferably but not necessarily, fairly rigid base plate (B), having a groove (or cradle) (cr) to keep the sound post (D) in position. This base plate may be either rigid or flexible, rigid is preferable. A pressure Spring Plate (C) holds the Sound Post (D) in position until it is ready to be transferred and released in proper location. The Spring Plate is longer than the Base Plate and has a lip C1 extending beyond the cradle (cr0, this spring plate is relatively smooth and is flexible so it will deflect under pressure. It can be either wire loop or flat strip, and can be either straight or bent as necessary. The two plates make up a Clamp which can hold a pin or a Sound Post in place. The drawing shows the Spring Plate C to be narrower than the base plate B, so it is easier to show the relationship of different parts. In fact the Spring Plate can be wider to improve stability.

The handle A has 3 main zones, grip portion a1, the Stem a2 and clamp end a3, while the basic handle can be a simple straight rod the 3 portions can be shaped to enhance performance and to add features. The Clamp is attached to a the handle (A) at the clamp end a3 of the handle. The stem of the handle (a2) needs to be sufficiently rigid and thin, such that it can be easily maneuvered along relatively narrow F-hole of the instrument. The grip of the handle (a1) can be made thicker for convenience. Making the clamp cradle (cr) sufficiently parallel to the stem of the handle a2 allows the operator to control movement and action of the clamp by either lateral movement or by rotation of the handle, thus allowing to more easily judge and set the angle and position of the sound post. With wire stem this angle can be modified to suit the user.

Figure 2:
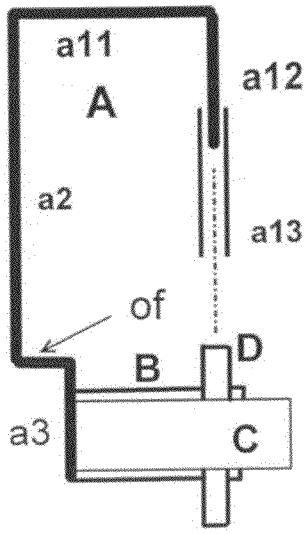

FIG. 2 shows one of many other alternative ways of making handle grip. Here by bending the top of the stem, (a11 and a12) Arm a12 points to the Sound Post, thus location of the Sound Post can be seen from outside the sound box. An extension (a13) can be added, when lowered it will point closely to sound post position. FIG. 2 also shows the handle end (a3) of the stem a2 is bent with an offset (of) allowing use of shorter clamp. The clamp can be inserted either at stem a2 or clamp end a3. This provides dual reach inside violin sound box. The clamp base (B) and handle (A) can be formed or molded as single element.

Principle of Operation

Construction of the tool can be best explained by showing how it operates.

Figure 3:
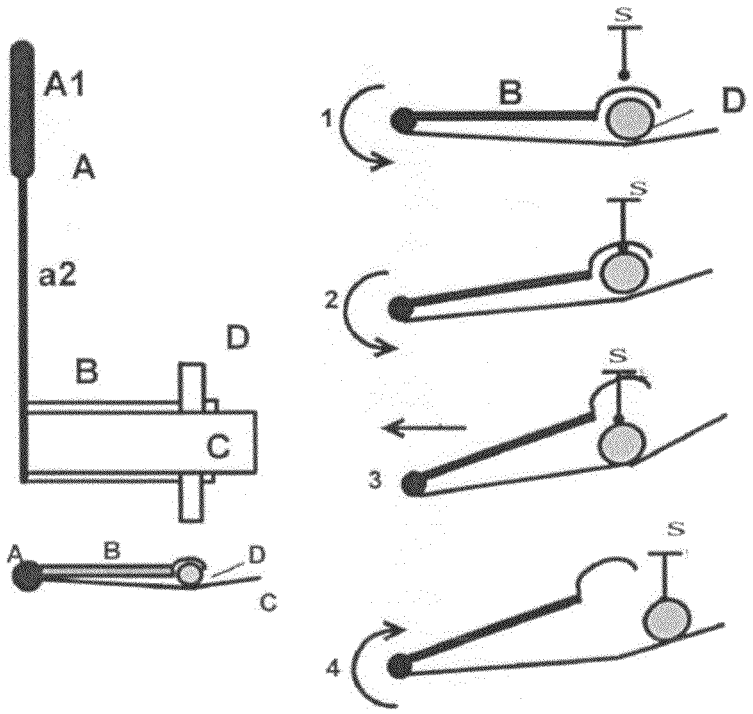

FIG. 3 helps explain the 4 steps to demonstrate the operation.

The Sound Post (D) is inserted into the tool and the assembly introduced inside the violin Sound Box. Positioning of sound post is controlled with the handle's lateral movement and by rotation.

Step 1. The tool is rotated with handle (A) as pivot point as Sound Post is moved towards the target.

Step 2. The rotation makes the Sound Post move towards an obstruction (S), which is such that it will capture the Sound Post and prevent any further movement of the Sound Post, Which in turn prevents movement of the Spring Plate (C), but will not obstruct the movement of the tool Base Plate (B). The stop points are also marked S in FIG. 3, where further movement of sound post is stopped at point where decreased height inside the sound box prevents further movement. Further rotation will cause the Spring Plate (C FIG. 2) to deflect (bend) while the base plate is moved further to separate from the sound post, as shown in step 3.

Step 3. The tool may now be moved laterally such that the base plate moves beyond the sound post.

Step 4. The tool is now rotated in the opposite direction and withdrawn, leaving the Sound Post at the chosen location.

Procedure can be reversed to remove the Sound Post from inside the sound box. The protruding lip of the Spring Plate is pressed against the Sound Post thus opening the clamp, then the Spring plate is made to slide along the Sound Post to set it in line with the cradle of the Base Plate. Removing pressure will close the clamp.

Figure 4:
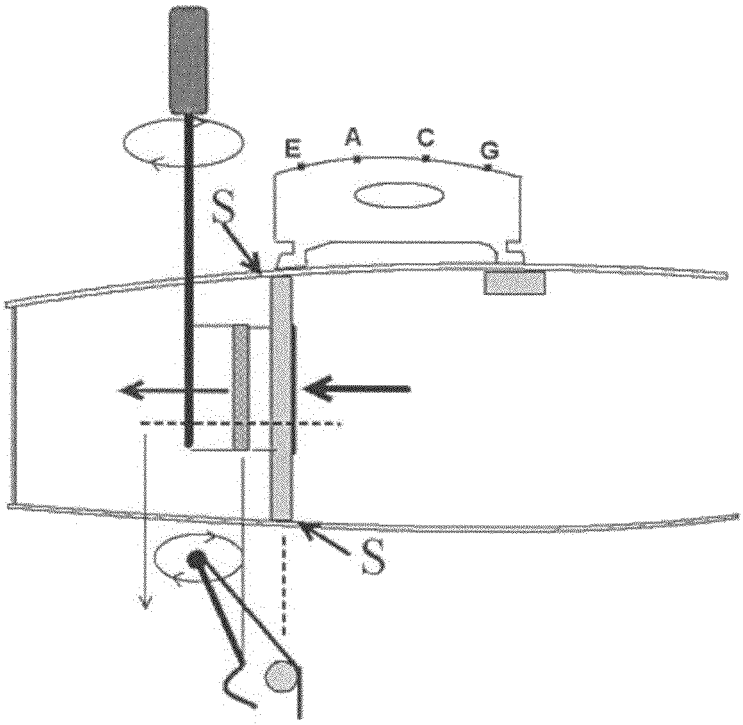

FIG. 4 demonstrates how the invention works inside the instrument sound box. The sound box in string instruments such as violin, viola or cello, include top and bottom acoustic boards, bent outwards in middle. In case of violin the Sound Post is inserted close to the bridge below the E-string leg. Those skilled in the art are well aware of different parts and their function in violin.

First, Sound Post is placed in the tool between the Base Plate and Pressure Spring. If total assembly is too thick, the tool is first inserted into sound box and then the Sound Post inserted into tool through the F-hole. Subsequently, by manipulating the handle, with lateral movement and/or by rotation, the Sound Post is moved close to center of the instrument (the highest part of the instrument) and then slowly moved to the desired spot, where it fits exactly between top and bottom acoustic boards (this was defined as S in FIG. 3 step 3). The handle is then turned such that the Spring Plate applies gentle force to push the Sound Post till it is jammed between the two acoustic plates.

When the handle is turned further, the Sound Post and the Spring Plate will not move, but the Base Plate will move and separate from Sound Post, thus freeing the Sound Post. The pressure spring is now free to slide along the Sound Post, and the base plate cradle is now moved away from the sound post far enough (As in FIG. 3, step 4) so the Sound Post gets clear of the base plate and only stay in contact with the extended portion of the Pressure Spring; beyond the end of the base. Then the handle can be rotated in opposite direction and the tool removed, without disturbing the sound post that is now set in place Using above concept a Simple and versatile Sound post tool (FIG. 1) for stringed instruments is constructed. The basic tool consists of a Handle (A) and laterally offset self locking Clamp (B and C). The Handle is a rod defined as a Stem (a2) with two ends, first end of the Stem is a grip end (a1) for control, second end is Clamp end (a3) to which a Clamp which holds the sound post is attached. The Clamp consists of two parts which are two plates substantially parallel to each other and have common connection at one end and is connected to the clamp end of the handle. First part (B) is Base Plate has at its free end indentation or cradle (Cr) to accept a Sound Post. Having the Cradle (c1) substantially parallel to the handle stem (a2) allows control of the clamp by lateral movement and by rotation of the handle. The length of the base plate contributes to lateral offset between handle and the clamp cradle allowing movement of sound post inside a violin sound box while handle is outside. The second part (C) is flexible Spring Plate and provides preloaded pressure at the cradle. This Spring Plate is elongated (c1) to protrude beyond cradle part of the Base. Elongated portion, when pressed against sound post that is inside instruments sound box, will open the clamp thus allowing to easily engage or release of the sound post. Thus Clamp action is fully controlled by rotation and lateral movement of the handle. This provides means to engage, transport, set and release a sound post simply by control of the handle of the tool FIG. 3.

FIG. 1 includes enlarged cross section view of the clamp and highlights thick Base plate (B) which can be made of solid metal or plastic said Base plate having a very thin cradle end (cr). The base plate and handle can also be molded or formed as a single unit for low cost mass production. Thus with addition of spring plate a tool having the base plate as integral part of the handle is built Handle Construction Options FIG. 1 Basic handle can be a simple straight rod. This may be modified to include performance enhancements. For clarity we describe the handle as rod defined as Stem (a2) and two ends, Grip end (a1) for control and Clamp end (a3) to which clamp is attached. Each part of the handle may be modified to achieve improvements.

FIG. 1 Handle A is made thicker at grip end (a1) for easy grip control.

FIG. 2 shows how the grip end of the handle is bent laterally once, (a11) to allow better grip.

The grip end of (all) handle stem is bent further to point towards the cradle at the clamp (a12). Effectively Grip end of the handle is looped back in relationship to stem creating offset allowing said grip end to point towards cradle at the clamp.

When sound post is inserted through F-hole inside string instrument sound box using tool in FIG. 2 adding adjustable extension tube (a13) that can slide along grip end of the handle (a12) allows extension tube (a13) to be lowered close to top of instrument sound box. This makes location of the sound post inside the instrument easily visible from outside of the instrument.

Further the end portion can be sharpened to help pick up a dropped sound post. If the handle is made from non hardened material it can further be formed by the user to perform other functions.

FIG. 2 Further the handle portion between base end (a3) and stem (a2) may also be bent to provide offset (of) to clamp end of the stem a3, allowing to use shorter clamp. This will also allow the handle to be inserted through sound box F-hole of instrument sound box at the clamp end a3 or at Stem portion a2, thus giving variable reach inside different sizes of violin or viola or any other string instrument.

Figure 18:
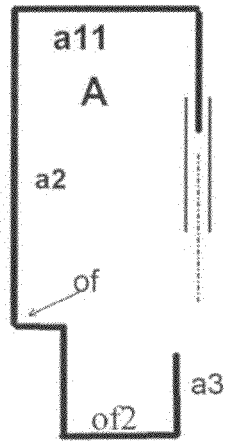
Figure 19:
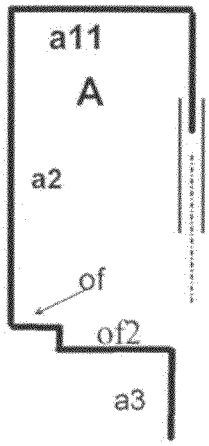
Figure 20:
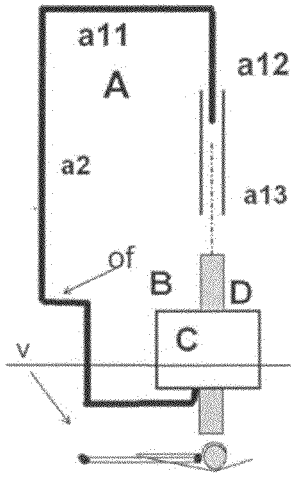

FIG. 19 Additional offset (of2) is added between handle stem and stem clamp end. This allows using shorter clamp (FIG. 20), which in turn allows thinner clamp (C) and still retain sufficient stiffness. Configuration in (FIG. 18) is alternative way of forming additional offset. If the handle is made of wire, it can also be bent and formed by the user.

Clamp Base Plate

Figures 5, 6, 7, 8, 9, 10, 11:
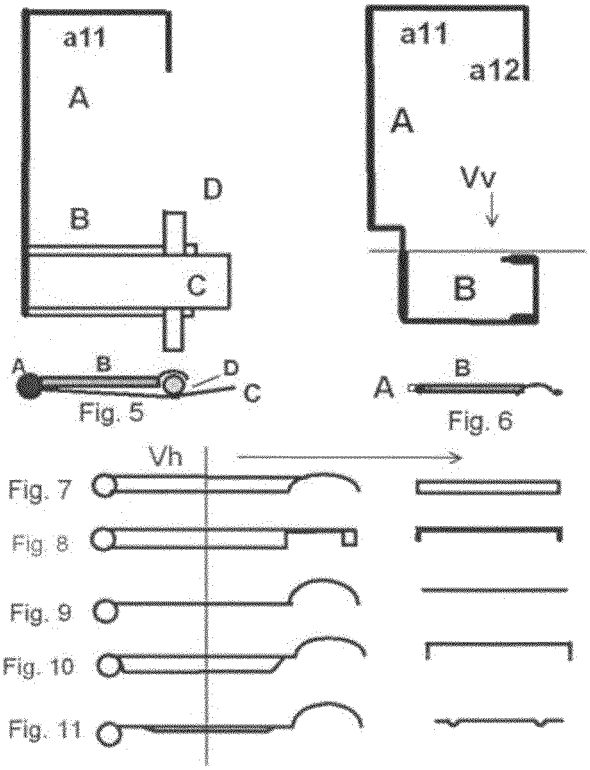

FIG. 5 shows basic construction.

FIGS. 6, 7, 8, 9, 10, and 11 also illustrates details of some of construction options of Base Plate.

FIG. 7 shows Base plate made of solid metal or plastic having a very thin cradle end. The base plate and handle can also be molded or formed as a single unit for low cost mass production. Thus with addition of spring plate a tool having the base plate as integral part of the handle is built.

FIG. 8 is metal or plastic extrusion having the cradle slot cut or formed.

FIG. 9 is simple base plate of thin material with end formed to make a cradle.

FIG. 10 is thin metal or plastic with edges bent to enhance rigidity.

Thin Clamp base plate (FIG. 11) is made more rigid by forming one or more indentations along length of the base plate.

With all these options the base plate is bonded, soldered, welded or attached to the handle with any established technique.

Figure 13:
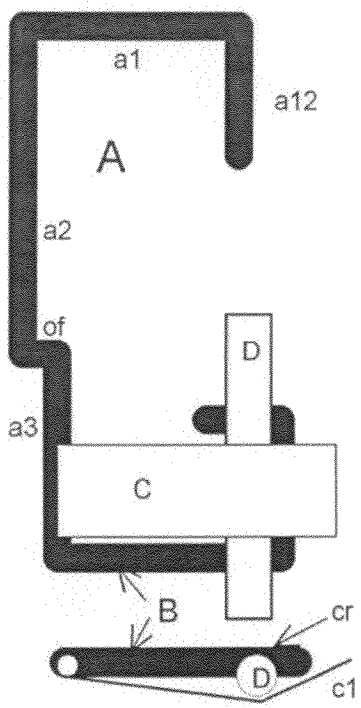
Figure 12:
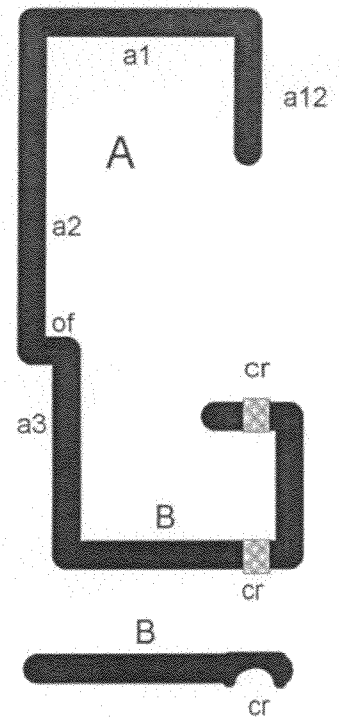
Figure 14:
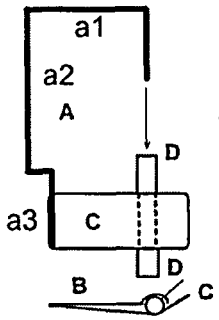

FIG. 6 shows integrated wire Handle and virtual Base Plate. This is shown in detail in FIG. 12 and FIG. 13. Clamp end (a3) of the handle stem (FIG. 12) is formed to laterally extend to position beyond normal cradle offset. Two indentations (cr) are formed to provide cradle for the sound post. Pressure Plate is attached directly at stem side (FIG. 13). Other options like handle grip ends (a1) and (a12) and offset (of) may also be added. Thus Sound post tool for stringed instruments providing means to engage, transport set and release a sound post simply by controlling the handle of the tool. The tool consists a Handle and laterally offset Clamp is formed. Handle is solid rod consists of a Stem (A) with two ends, first end (a1) is a grip end for control, second end is a clamp end (a3) and is extended and formed and indentations (Cr) added to form effective cradle for the sound post offset laterally from the handle stem and substantially parallel to the stem. Flexible Spring Plate (C) is added and provides retaining pressure to the to the sound post when located in the cradle Spring Plate (C) is elongated to protrude beyond cradle part.

Single Piece Clamp Preferred Option

Details in FIG. 14, FIG. 15, FIG. 16, and FIG. 17 show yet another concept, which allows smaller overall tool thickness. Also the area around the sound post is kept at minimum. Here both Base Plate and Spring Plate are made of single piece of very thin metal, folded and formed to produce self locking clamp that includes Base plate(B) with cradle and the Spring Plate(C) elongated beyond cradle.

Figure 15:
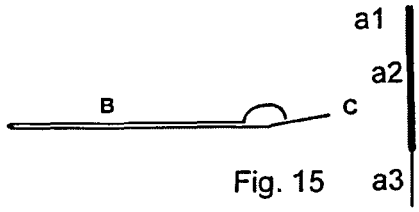

In FIG. 15 this clamp is attached or welded to the flattened stem end of the handle Base Plate can be stiffened either by adding thicker material or forming a rib along its length (FIG. 11).

The handle can be flattened and formed to hold clamp blades without welding

Figure 16:
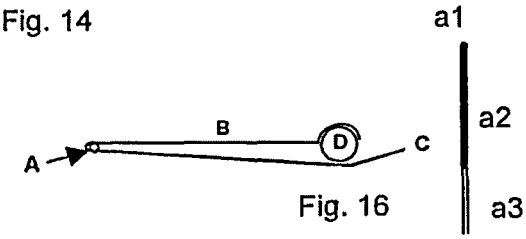

In FIG. 16 Handle stem Clamp end is formed into a fork and straddles base portion of the clamp. This system makes the clamp removable and reversible to fit right handed or left handed instrument. Also the forked end can be attached to straddle any portion of Base plate allowing various cradle offset options.

Figure 17:
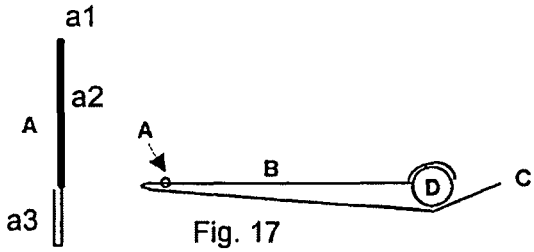

FIG. 17 has the handle stem Clamp end formed into a tight loop thus retaining the clamp. This system again makes the clamp removable and reversible to fit right handed or left handed instrument. Also the looped end can be attached to straddle any portion of Base plate allowing various cradle offset options.

Figure 21:
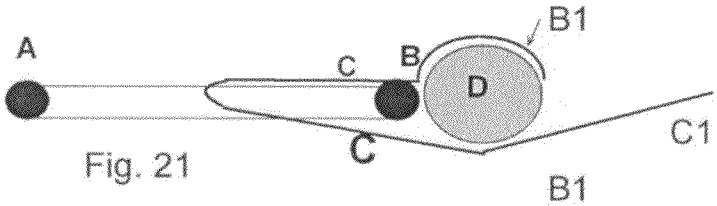

FIG. 21 shows that any point of the clamp can be attached to the clamp end of the handle stem, including at or near the cradle B1. Here as in) most of the offset (of plus of2) (FIG. 19 is achieved by forming the handle between stem (a2) and clamp end portion a3 of handle stem. This combination of cradle B1 and handle end a3 makes up functional base plate. Spring plate is folded to increase its effective length.

Utilizing extra offset we now build sound post tool (FIG. 20) with handle portion formed to provide most of offset between stem and clamp end of the handle and clamp portion that is close the cradle is attached to clamp end of the handle.

Figure 22:
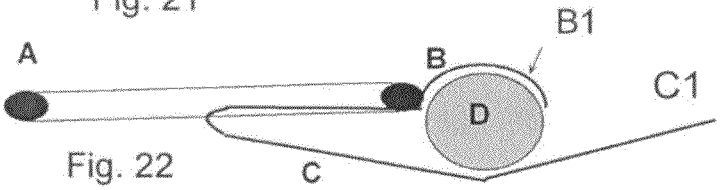

FIG. 22 shows alternate way of clamp assembly. This system provides effect of stiffer Base Plate.

This invention discloses three variations using invention principles.

Figure 23:
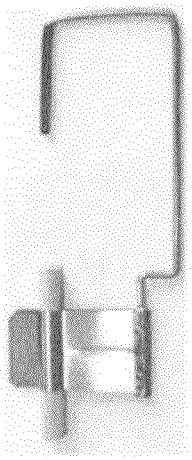

Tool using thin clamp FIG. 23. Best suited for use in small size instruments.

Figure 24:
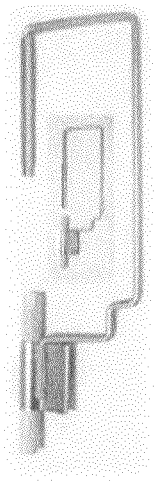

Offset by forming handle FIG. 24. Stiffer effect of clamp base, but wire thickness adds to height of clamp.

Figure 25:
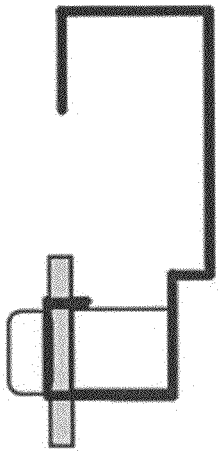

Integrated handle and clamp base makes inexpensive tool for economy FIG. 25.

What is claimed is:

1. Sound post tool for stringed instruments providing means to engage, transport, set and release a sound post simply by controlling a handle of the tool, the tool consists of a Handle and laterally offset self locking Clamp where the Handle is a Rod defined as a Stem with two ends, first end of the stem is a grip end for control, second end is a clamp end attached to Clamp which holds the sound post, said Clamp consists of two parts which are two plates substantially parallel to each other and have common connection at one end; first part, a Base Plate has at a free end indentation or cradle, substantially parallel to handle stem, to accept a Sound Post and a second part as a flexible Spring Plate provides preloaded pressure at the cradle, further this Spring Plate is elongated to protrude beyond cradle part of the Base Plate making clamp action fully controlled by rotation and lateral movement of the handle.

2. Sound post tool for stringed instruments as in claim 1, wherein base plate part of the clamp and handle are formed from a single element thus making tool having base plate integral part of the handle.

3. Sound post tool for stringed instruments as in claim 1, wherein, base plate and spring plate of the clamp are made from single thin strip folded and formed to produce a clamp that includes Base plate with cradle and the Spring Plate.

4. Sound post tool for stringed instruments as in claim as in claim 1 wherein handle portion between stem and clamp end is formed to provide lateral offset between Stem and clamp end of the handle.

5. Sound post tool for stringed instruments as in claim 1 wherein Grip end of the handle stem is looped back in relationship to stem creating offset allowing said grip end to point towards cradle at the clamp.

6. Sound post tool for stringed instruments as in claim as in claim 1 wherein Clamp base plate is thin metal with indentations pressed along its length to increase rigidity.

7. Sound post tool for stringed instruments as in claim 5 wherein handle part between stem and clamp end of the handle is formed to increase lateral offset between cradle of the clamp and the handle stem thus allowing use of shorter clamp.

8. Sound post tool for stringed instruments as in claim 1 wherein Grip end of handle stem is made thicker.

9. Sound post tool for stringed instruments as in claim 5 wherein the grip end of handle includes a sliding member thus providing adjustable pointer to position of cradle part of the clamp.

10. Sound post tool for stringed instruments providing means to engage, transport set and release a sound post simply by controlling a handle of the tool, the tool consists a Handle and laterally offset Clamp where Handle is solid rod consists of a Stem with two ends, first end is a grip end for control, second end is a clamp end and is extended and formed to make support for the sound post, the clamp end consists of a base plate and a spring plate substantially parallel to each other having indentations added to form effective cradle for the sound post offset laterally from the handle stem and substantially parallel to the stem wherein spring plate is flexible and provides retaining pressure to the sound post when located in the cradle while Spring Plate is elongated to protrude beyond cradle part.

11. Sound post tool for stringed instruments as in claim 7 wherein the clamp is attached to the handle near the cradle part of the base plate of the clamp.

12. Sound post tool for stringed instruments as in claim 3, wherein the handle clamp end is formed into a tight loop to secure clamp to the handle.

13. Sound post tool for stringed instruments as in claim 3, wherein the handle clamp end is formed into a tight fork to straddle base plate and secure clamp to the handle.

14. Sound post tool for stringed instruments as in claim 2 wherein handle and base plate of the clamp are formed from plastic.

* * * * *